US006045335A

United States Patent [19]

Dinning

[11] Patent Number: 6,045,335

[45] Date of Patent: Apr. 4, 2000

[54] DIFFERENTIAL PRESSURE OPERATED FREE PISTON FOR LIFTING WELL FLUIDS

[76] Inventor: Robert W. Dinning, 9901 Westview, Houston, Tex. 77055

[21] Appl. No.: 09/036,959

[22] Filed: Mar. 9, 1998

[51] Int. Cl.[7] ..... F04B 47/12; E21B 43/00

[52] U.S. Cl. ..... 417/59; 166/372

[58] Field of Search ..... 417/56, 57, 58, 417/59, 60, 555.1; 166/372

[56] References Cited

U.S. PATENT DOCUMENTS

| | | | |
|---|---|---|---|
| 1,790,450 | 1/1931 | Torrance | 166/372 |
| 2,674,951 | 4/1954 | Zaba | 103/52 |
| 2,830,540 | 4/1958 | Vincent | 103/52 |
| 3,273,504 | 9/1966 | Lyles | 103/52 |
| 4,070,134 | 1/1978 | Gramling | 417/56 |
| 4,363,606 | 12/1982 | Kilgore | 417/59 |
| 4,531,891 | 7/1985 | Coles, III | 417/59 |
| 4,923,372 | 5/1990 | Ferguson et al. | 417/53 |
| 5,253,713 | 10/1993 | Gregg et al. | 166/372 |
| 5,427,504 | 6/1995 | Dinning et al. | 417/59 |

*Primary Examiner*—Teresa Walberg
*Assistant Examiner*—Daniel Robinson
*Attorney, Agent, or Firm*—Bill B. Berryhill

[57] ABSTRACT

A differential pressure operated free piston for lifting well fluids from a subterranean reservoir to the surface through a well conduit. The free piston includes a piston body adapted for up and down sliding disposition within the conduit and a sealing assembly carried in a cylindrical space surrounding the piston body. The sealing assembly includes upper and lower juxtaposed sets of longitudinally separated cylindrical segments providing relatively smooth cylindrical surfaces on the exterior thereof for sliding and sealing contact with inner walls of the conduit, the upper and lower set of segments being radially oriented so that separations between the segments of the upper set and separations between the segments of the lower set are not aligned, providing a seal which, when pressure in the well conduit near the surface is subsequently reduced, sufficiently elevates the piston and well fluids thereabove to the surface.

18 Claims, 3 Drawing Sheets

DIFFERENTIAL PRESSURE OPERATED FREE PISTON FOR LIFTING WELL FLUIDS

BACKGROUND OF THE INVENTION

1. Field of the Invention

The present invention pertains to apparatus for lifting well fluids from a subterranean reservoir. More specifically, the present invention pertains to differential pressure operated free pistons, sometimes referred to as "gas operated plungers", for lifting well fluids from a subterranean reservoir through a well conduit which extends to the surface.

2. Description of the Prior Art

Differential pressure operated pistons, or plungers, have long been utilized in producing subterranean wells where the natural gas pressure in the well is insufficient to produce a free flow of fluids to the surface. Such devices generally include a free piston or plunger element which slidingly and sealingly engages the inner walls of a well conduit which extends upwardly from the well reservoir to the surface. The well conduit, normally referred to as a production string, may be either a casing string or a tubing string disposed within a casing string.

Typically, the free piston or plunger is provided with external sealing elements for sealingly and slidingly engaging the inner walls of the well conduit. However, the free piston or plunger may typically be provided with an internal passage which bypasses the external sealing elements and allows the piston or plunger to gravitate or fall from the surface of the well to the reservoir. A valve mechanism is typically provided within the body of the piston and is effective to close the internal passage through the piston when the piston has reached a preselected depth in the well. This preselected position may be determined by a stop device, sometimes referred to as a tubing stop, which is semipermanently located in the well conduit. The tubing stop may be relocated, from the surface of the well, at different depths in the conduit as well conditions change.

When the piston or plunger reaches the tubing stop, contact with the stop cause the valve mechanism therein to close, blocking internal passage through the piston or plunger. The piston remains in this position while well fluids accumulate above the piston and gas pressure begins to build. After a pre-selected time, a control valve at the surface of the well opens, allowing flow of fluids to commence. The differential pressure between the surface of the well and higher pressures below the piston force the piston and the well fluids thereabove to the surface. On arrival of the piston at the surface, it is captured in a capturing unit and the internal valve is opened, opening the internal flow passage through the plunger. At the same time the control valve is closed. This allows the piston to gravitate to the bottom of the well conduit until stopped by the tubing stop. The piston valve is again closed and the next cycle begins. Examples of such prior art gas operated or differential gas operated piston or plunger apparatus may be seen in U.S. Pat. Nos. 4,070,134 and 4,923,372.

Most differential pressure operated pistons or plungers of the prior art have inherent problems. One problem is with the seal between the plunger and the inner walls of the well conduit. The seal must be capable of sliding past restrictions within the well conduit; yet slidingly and sealingly engageable with the inner walls of the conduit sufficiently to provide the pressure differential necessary for elevating the piston and well fluids thereabove to the surface of the well. It must be capable of doing so without undue damage to the seal. This type of seal frequently comprises a plurality of metallic pads or longitudinally separated cylindrical segments on the exterior of which are provided relatively smooth cylindrical surfaces. These pads or segments are radially moveable between an innermost position and an outermost position so that the seal may contract as it passes through restrictive portions of the well conduit but may expand to sealingly and slidingly engage the well conduit to provide the necessary seal. Typically, some type of biasing means is provided to bias the sealing elements or pads toward their outermost positions. However a considerable amount of leakage and bypassing occurs between the interior surfaces of the pads or segments and the piston body. This of course increases the pressure necessary to elevate the piston and well fluids from the subterranean formation to the surface of the well. In addition, in the piston designs of the prior art, the segments or pads inherently leak through the longitudinal spaces or separations between adjacent segments or pads. These spaces are wider and leak more as the internal diameter of the well conduit increases, as is frequently the case with upper portions of a well conduit. This type of leakage also increases the pressure necessary for lifting of the piston and well fluids, requiring more piston trips.

Furthermore, the flow and leakage between the interior of the segments or pads and the piston body and between the spaces between the longitudinal separation or spaces between segments or pads causes erosion which will erode the piston body and the sealing elements, further increasing the pressure necessary to elevate the piston and well fluids to the surface of the well and eventually eroding these elements to such an extent that they are no longer useable, requiring repair and or replacement at considerable expense.

In many of the differential pressure operated pistons or plungers of the prior art, particularly those in current use, a rod is concentrically mounted in an internal flow passage therethrough. The purpose of the rod is to reopen the piston valve when it reaches the surface of a well. Typically, the rod would engage a spring loaded stop at the surface of a well causing the rod to move downwardly to engage a valve closure member, unseating the closure member and opening the valve. Such a design severely restricts flow through the internal flow passage as the plunger is falling back to the bottom of the well. In some conditions it restricts the flow to such an extent that the plunger will not fall without added weight. This type of design is costly, requires corrections for the additional moving weight and creates other hazards for the piston as it returns to the surface. With pistons or plungers provided with internal bypasses and valves, fluid flow through the piston (when falling) should be maintained at an uninterrupted maximum. If not, the piston will fall erraticly and may not reach the depth required to close its valve. If the valve does not close the piston will not return to the surface on its own accord, requiring a costly fishing operation to free the piston. In addition to the above mentioned problems, the rod provided to the valve is necessarily small, fragile and susceptible to damage.

Some designs have attempted to solve the problems associated with a rod in the internal flow passage of the piston by providing a rod and a lubricator bumper sub typically installed at the upper end of the well conduit. Such a rod is designed to penetrate the piston flow passage to contact the valve closure member and push it off its seat at the instant the piston contacts a spring loaded stop in the lubricator bumper sub. This requires accurate and sensitive adjustments which are not always possible in field situations. Furthermore, there are many hazards and damage possibilities when the piston, traveling under pressure, is propelled against a stationary rod. There are so many disadvantages of this design, that very few well operators utilize it.

U.S. Pat. No. 5,427,504 discloses a recently designed piston or plunger which eliminates many of the problems of the prior art by providing a sealing assembly which comprises a plurality of longitudinally divided cylindrical segments or pads for sliding and sealing contact with the well conduit walls. Adjacent edges of adjacent ones of the cylindrical segments are provided with overlapping or stepped opposing surfaces which are slidingly engageable with each other as the cylindrical segments move radially between inwardly contracted and outwardly expanded positions. A resilient inner seal is also provided between the piston body and inner surfaces of the segments to reduce leakage between the segments and the piston body. While this tool is much more effective than those of the prior art, the overlapping or stepped cylindrical segments are not easily manufactured. In addition its resilient inner seal of rubber or other resilient compounds will not last for extended periods of time in the harsh environments to which it is subjected.

Thus, the search continues for differential pressure operated pistons or plungers with effective sealing capabilities for lifting well fluids to the surface of a well without the inherent problems of the pistons and plungers of the prior art, i.e. leakage, erosion, erratic operation, unsafe operation, failure, costly remedial operations, etc.

SUMMARY OF THE PRESENT INVENTION

The present invention provides a differential pressure operated piston for lifting well fluids from a subterranean reservoir through a well conduit which extends to the surface. The piston comprises: a plunger body adapted for up and down sliding disposition within the well conduit having an upper portion, a lower portion and an intermediate portion of reduced diameter. Downwardly facing surfaces of the upper portion, upwardly facing surfaces of the lower portion and the exterior of the intermediate portion substantially define an elongated cylindrical space in which is carried a sealing assembly comprising upper and lower juxtaposed sets of longitudinally separated cylindrical segments or pads.

Each of the segments of a set of segments provides a relatively smooth cylindrical surface on the exterior thereof for sliding and sealing contact with inner walls of the well conduit. The lower ends of each segment of the upper set of segments and the upper ends of each segment of the lower set of segments provide relatively smooth mutually engaging surfaces for sliding and sealing contact therebetween. In addition, the upper and lower sets of segments are radially oriented so that the separations between the segments of said upper set and the separations between the segments of said lower set are not aligned, preventing upward flow of well fluids through the separations between the segments. A rigid ring member surrounds the intermediate portion of the piston body and has upper and lower end surfaces which are mutually and respectively engageable with corresponding surfaces on lower ends of the upper set of cylindrical segments and upper ends of the lower set of cylindrical segments to block flow of fluids between the piston body and the cylindrical seal segments or pads. Each of the cylindrical segments or pads of the upper and lower sets of segments is radially moveable between inner positions and outer positions in which the exterior cylindrical surfaces provided thereon slidingly and sealingly engage the inner walls of the well conduit. Biasing means disposed between the cylindrical segments and the intermediate piston body portion bias the segments toward their outer positions, the sealing assembly then providing a seal which is sufficient to elevate the piston and well fluids thereabove to the surface.

In a preferred embodiment of the invention there is no passage or bypass through the piston body. However, there is, by design, enough play or tolerance in the sealing assembly to allow some leakage and to allow the piston to gravitate through the well conduit toward the reservoir. Once it reaches the piston stop, differential gas pressure and design of the sealing elements establishes sufficient sealing to elevate the piston and well fluids thereabove to the surface upon subsequent opening of a valve at the surface of the well.

In another preferred embodiment of the invention the sealing assembly also comprises a sleeve member which surrounds the intermediate piston body portion and the length of which is less than the length of the elongated cylindrical space in which it is disposed. This allows limited axial movement of the sealing assembly within the cylindrical space between upper and lower terminal positions therein. The piston body is also provided with a central flow passage the lower end of which communicates with a portion of the well conduit below the sealing assembly and the upper end of which is connected to one or more radial passages in the intermediate piston body portion. The radial passages are blocked by the sleeve member in its lower terminal position, blocking fluid flow through the central flow passage. However the sleeve member is provided with one or more radial passages which, when the sleeve member is in its upper terminal positions, are in corresponding registration with the radial passages in the intermediate piston body portion to allow fluid flow through the central flow passage. This position, assumed when the piston is being dropped, allows the piston to gravitate to the bottom of the well in a much shorter time. However, when the piston reaches the piston stop, gravity and inertia cause the sleeve and the elements of the sealing assembly to move to the lower terminal position in which the central flow passage is blocked, allowing gas pressure therebelow to increase for eventually elevating the piston and the well fluids thereabove to the surface.

The differential pressure operated piston of the present invention provides sealing elements which are unique in design. There are two sets, one above the other, of preferably metal pads or cylindrical segments on which are provided cylindrical surfaces for efficient sealing against the inner walls of the well conduit of variable diameter. The juxtaposed sets of pads or segments are radially oriented so that opposing ends thereof seal against each other blocking flow of fluids through the longitudinal separations therebetween. These segments also seal, on the interior thereof, against a rigid ring provided around the intermediate piston body portion, preventing flow of fluids through the space between the intermediate body portion and the segments. Thus no expanding or flexible seal is required beneath the segments or pads, eliminating the deterioration and replacement problems associated with such seals of the prior art. This design allows, as in one embodiment, operation without an internal bypass. In another embodiment, an internal bypass is provided and the sealing assembly is mounted on a sliding sleeve which opens or closes the bypass as desired.

The unique piston assembly designs of the present invention provide reduced leakage, reduced damage from erosion, eliminates the problems associated with a resilient seal and is substantially trouble free in operation. It is easy to assembly, disassemble and use. Many other objects and advantages of the invention will be apparent from reading the description which follows in conjunction with the accompanying drawings.

DESCRIPTION OF PREFERRED EMBODIMENTS

Figure 1:
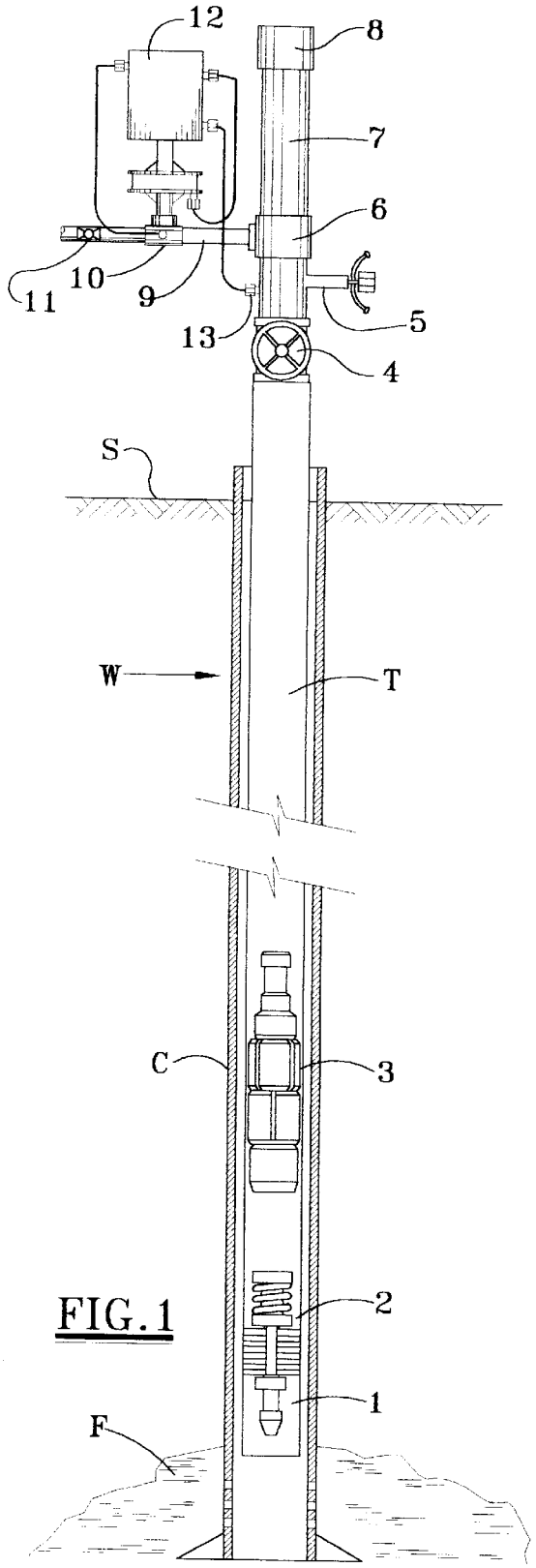
FIG. 1 is a schematic representation of a well installation for producing well fluids from a subterranean formation and illustrating production of the well by utilizing a differential pressure operated piston according to a preferred embodiment of the invention.

Referring first to FIG. 1 there is shown a well W for producing hydrocarbon fluids from a subterranean formation F. One or more well conduits extend from the subterranean formation F to the surface. In the exemplary embodiment there is a casing string C, and concentrically therein, a tubing string T. The tubing string T, which may be referred to as the production string, may sometimes exist without a casing string. In any event, the tubing string T is the well conduit through which fluids from the subterranean formation F flow or are raised to the surface S.

Near the bottom of the tubing string T is a retrievable and standing valve assembly 1 and a stop mechanism 2 mounted in any conventional manner, e.g. slips. These elements may be relocated by wire line operations or the like from the surface of the well W, at different depths, as well conditions change. The stop mechanism 2 would preferably incorporate a spring of some type for arresting downward movement of a free piston type pump unit 3 which is slidably and sealably disposed in the tubing string T. The free piston pump unit 3 embodies the present invention and will be described in much greater detail hereafter.

At the surface of the well W is a full opening master valve 4 suitably secured to the tubing string T to totally block fluids from the tubing string T when desired. Closing of the valve 4 at the proper time will also allow retrieval of the free piston pump 3 for inspection or repair. Above the valve 4 is a catching unit 5, a flow tee 6 and a lubricator bumper sub 7 closed at its upper end by a detachable end cap 8. The bumper sub 7 is conventionally provided therein with a spring member (not shown) which is engageable by the free piston 3 when rising through the tubing string T to arrest movement of the free piston 3 and cushion the shock thereon when the movement is arrested.

Connected to the flow tee 6 is a flow line 9 in which is installed a motor operated control valve 10 and possibly a flow choke 11. The valve 10 is controlled and operated by a pressure drop sensitive closing unit or controller 12. The controller 12 is connected to a piston sensing device 13 which senses the arrival of the free piston 3 as it passes by the piston catching unit 5 into the lubricator sub 7. The control unit 12 controls operation of the valve 10, opening the valve 10 at predetermined intervals to allow flow of well fluids through the flow line 9 and closing the valve 10 on arrival of the free piston 3 in the bumper sub 7, as will be more fully understood hereafter.

Referring now to FIGS. 2–6, a preferred embodiment of the free piston 3 will be described in more detail. The piston 3 has a piston body made up of an upper portion 20, a lower portion 21 and an intermediate cylindrical portion 22 of reduced diameter. Downwardly facing surfaces of the upper portion 20 and upwardly facing surfaces of the lower portion 21 and the exterior of the intermediate portion 22 substantially define an elongated cylindrical space having a central axis which coincides with the axis of the piston body 20, 21, 22. In the preferred embodiment, the lower portion 21 of the piston body may be concentrically bored and threaded for connection at 23 with corresponding threads on the lower end of the intermediate body portion 22. The lower portion 21 may be provided with wrench flats 24 for aiding in the engagement or disengagement of the threaded connection 23. Threaded radial holes and set screws 25 may be provided which may be tightened when the lower portion 21 is fully made up, as in FIG. 2, to prevent accidental loosening or disengagement. Loosening of the set screws 25 allows removal of the lower portion 21 and disassembly of other components of the free piston 3.

The upper portion 20 of the free piston body may include a cylindrical head 26 and a reduced diameter neck 27 for engagement by fishing tools if it ever becomes necessary to mechanically retrieve the free piston 3 from the well. Wrench flats 28 may be provided to assist in assembly and disassembly of the free piston unit 3.

The lower end of the upper piston body portion 20 is provided with downwardly facing annular surfaces 30 and 32 joined by frusto-conical surface 31. A frusto-conical surface 33 connects the annular surface 32 with the outside diameter of upper body portion 20. The surfaces 31 and 32 are highly polished to help form a metal-to-metal type seal as will be more fully understood hereafter. The surfaces 30 and 31, along with the external surface of intermediate body portion 22 form a downwardly facing groove the purpose of which will be more fully understood hereafter also.

The lower piston body portion 21 is also provided with a pair of upwardly facing annular surfaces 34 and 36 joined by frusto-conical surface 35. A frusto-conical surface 37 connects the annular surface 36 with the external diameter of the lower body portion 21. The surfaces 35 and 36, as with surfaces 31 and 32 of the upper body portion, are highly polished to help provide a metal-to-metal type seal. The surfaces 34 and 35 along with the exterior surface of intermediate body portion 22 form an upwardly facing groove.

Carried in the cylindrical space surrounding the intermediate portion of the piston body 22 is a sealing assembly which comprises two sets of longitudinally separated cylindrical segments, an upper set 40 and a lower set 60. In the exemplary embodiment the upper set 40 is formed of four identical cylindrical segments 41, 42, 43, 44. The lower set also has four identical cylindrical segments 61, 62, 63 and 64. Each of the segments 41–44 and 61–64 provide relatively smooth cylindrical surfaces on the exterior thereof for sliding and sealing contact with inner walls of conduits, such as the tubing T of FIG. 1. The lower ends of each upper set segment 41–44 and upper ends of each lower set segment 61–64 are provided with relatively smooth, mutually engaging surfaces for sliding and sealing contact as at 51, 52 and 53 in FIG. 2.

Each of the cylindrical segments 41–44, 61–64 of the upper and lower sets of segments 40 and 60, respectively, are radially moveable between inner positions, in which the exterior cylindrical surfaces thereof lie within a circle whose diameter is less than any anticipated restriction which may be encountered in the conduit or tubing T, and outer positions in which said exterior cylindrical surfaces slidingly and sealingly engage the inner walls of the conduit or tubing T. Biasing means, such as the spring assembly 70 in FIG. 2 and shown in greater detail in FIG. 6 are disposed between the cylindrical segments 41–44 and 61–64 and the intermediate piston body portion 22, biasing the segments 41–44 and 61–64 toward the outer positions.

Figure 6:
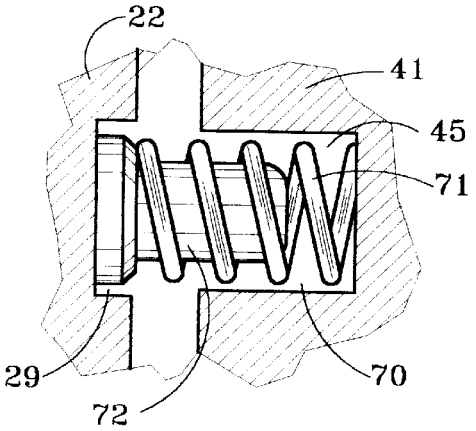
FIG. 6 is a detailed drawing, partially in section, illustrating biasing elements of the sealing means of the present invention, according to a preferred embodiment thereof.

As best seen in FIG. 6 the biasing means 70 may take the form of a helically wound spring 71 and a supporting plug 72. The spring 71 and plug 72 are mounted in corresponding blind bottom holes 29 and 45 radially provided in the intermediate piston body portion 22 and each one of the segments 41–44 and 61–64, respectively. In an alternate embodiment, illustrated in FIG. 7, the plug 72 is replaced by an end cap 73.

Figure 3:
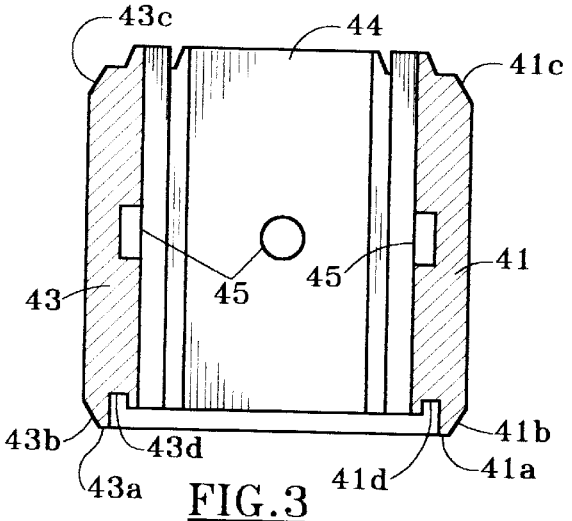
FIG. 3 is a longitudinal view, in section, of one set of four sealing segments which cooperate to form sealing means for use with the present invention, the section being taken along lines 3-3 of FIG. 4.
Figure 4:
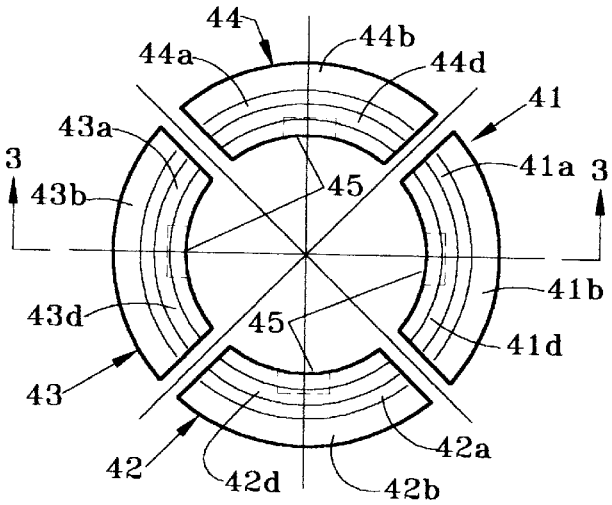
FIG. 4 is an end view of the four sealing segments of FIG. 3 as seen from the bottom thereof.
Figure 5:
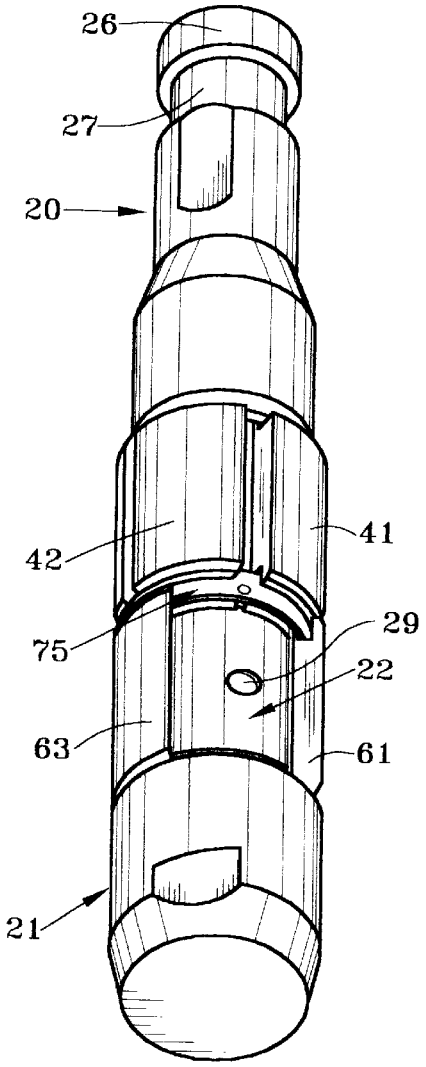
FIG. 5 is a pictorial representation of the differential pressure operated piston of the preferred embodiment of FIGS. 2–4.

The upper and lower outer ends of each set of segments 40 and 60 are tapered as shown in FIGS. 3 and 4 for the upper set 40 at 41*b*–44*b*, 41*c*–44*c*, so that upon engagement of either end of the sets of segments 40 and 60 with a restriction in the well conduit, whether the piston is moving downwardly or upwardly, within a well conduit such as tubing T, the segments will be forced inwardly toward their inner positions to pass through the restriction. Once the segments pass through the restriction, the biasing means will force the segments outwardly to again slidingly and sealingly engage the inner walls of the conduit.

The sealing assembly also includes a rigid ring member 75 surrounding the intermediate portion 22 of the piston body. The ring member 75 has upper and lower highly polished end surfaces 76, 77 which engage corresponding segmented annular recesses 41*d*–44*d* on the lower ends of the upper sets of cylindrical segments 40 and on the upper ends of the lower set of cylindrical segments 60 so that the outer radial movement of the cylindrical segments 41–44 and 61–64 is limited. The ring member 75 has an inner shoulder 78 which butts against the shoulder 38 of the intermediate body portion to hold the ring 75 in its proper longitudinal position when assembled.

The end surfaces 76 and 77 of the ring member 75 and the corresponding surfaces on segments 41–44 and 61–64 are highly polished for mutual sliding and sealing engagement therebetween.

Thus metal-to-metal type sliding seals are provided, as already stated, at mutual contacts 51–54 between the upper set of segments 41–44 and the lower set of segments 61–64 and at the contact of these segments with the upper and lower ends 76, 77 of the ring 75. In the pictorial representation of FIG. 5, one of the segments 62 has been removed to better illustrate the relationship between the segments 41–44, 61–64, the ring member 75 and the piston body portions 20, 21, 22.

It will also be noted that the segments 41–44 of the upper set of segments 40 and the segments 61–64 of the lower set of segments 60 are radially oriented so that the separations between the segments of the upper set 40 and the separation between the segments of the lower set 60 are not aligned. In the preferred embodiment, one set is rotated forty-five degrees relative to the other set. In this manner one end of the separations between segments of one set are blocked by mutually engaging surfaces on the opposing set of segments. The orientation of the upper and lower set of segments 40, 60 and the mutually engaging sealing surfaces on the ends of the segments with each other and with the ends 76, 77 of the ring 75 provide a seal which allows the free piston 3 to gravitate through a conduit such as tubing T but provide sufficient sealing, when pressure in the well conduit near the surface is subsequently reduced, to elevate the piston 3 and well fluids thereabove to the surface.

Figure 2:
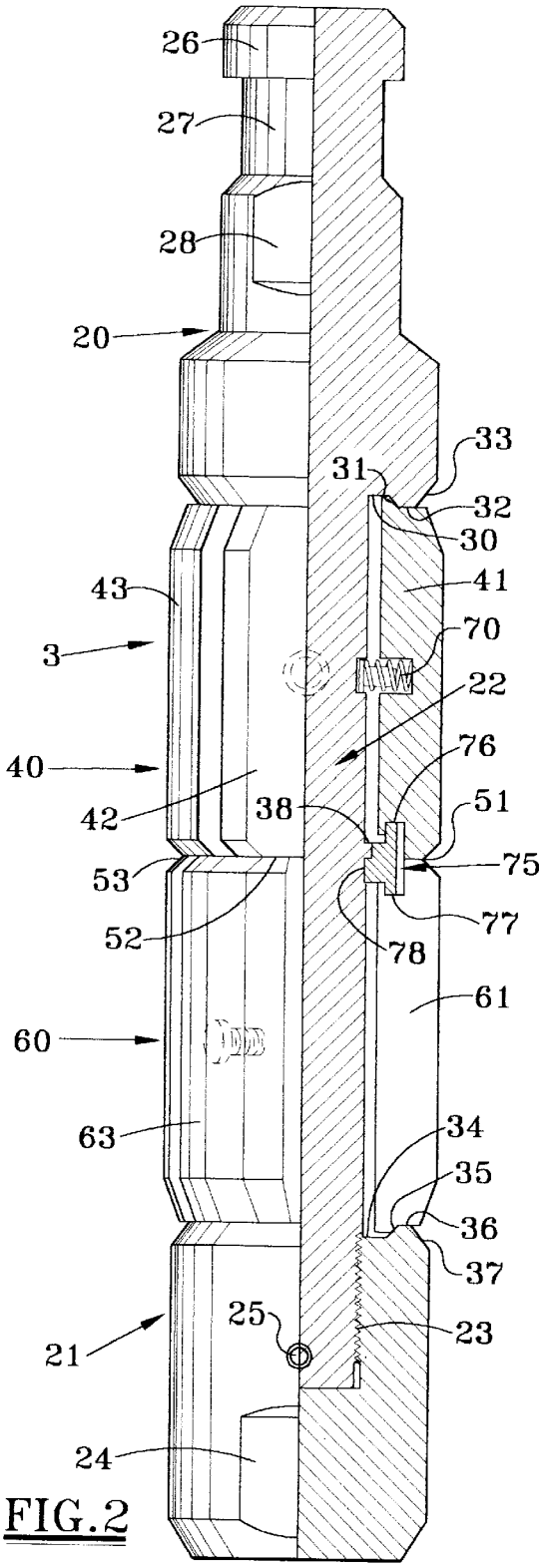
FIG. 2 is a longitudinal view, in quarter section, of a differential pressure operated piston according to a preferred embodiment of the invention.

Referring, especially now, to FIGS. 1 and 2, operation of the free piston pump 3 will be explained. The free piston pump 3 is preferably used in wells where gas pressure alone is insufficient to flow or produce significant fluids at the surface. Hydrocarbons from many of such wells cannot be recovered except through the installation of conventional rod-operated or submersible pumps with considerable expense, daily inspection and maintenance.

Furthermore, in wells producing primarily gas, gas production may be substantially impaired by liquids accumulating in the bottom of the well whether such liquids are hydrocarbons or salt water. In either event, it is desirable to remove the liquid from the bottom of the well without installing conventional pumping units.

Initially, the free piston 3 is placed in the production string T through the lubricator sub 7. This is done by removing the cap 8 while the valve 4 is closed. Then the cap 8 is replaced, the valve 4 opened, and the free piston 3 allowed to gravitate or fall to the bottom of the well through the tubing string T. All of the sealing segments or pads 41–44 and 61–64 are biased outwardly for sliding and sealing engagement with the interior of the well conduit T. There is a small amount of leakage around the sealing segments sets 40 and 60. This permits the free piston to fall under its own weight toward the stop 2 which will eventually arrest it's downward movement. As this occurs, the motor operated valve 10 is closed and a time sequence is initiated by the controller 12. Fluids enter the production string T and gas pressure begins to build. The controller 12 is programmed to keep the valve 10 closed until substantial fluids have entered the production string T and sufficient gas pressure has built up. The amount of time necessary will be different for every well and may change over the life of the well. However, after a predetermined amount of time, the controller 12 opens the valve 10, substantially reducing pressure above the free piston 3 so that the pressure differential between the accumulated gas pressure below the free piston and the pressure in the fluids above the free piston forces the free piston 3 and the fluids trapped thereabove upwardly through the well conduit or production string T through the flow tee 6, the valve 10 and choke 11 toward a tank (not shown) for production of the well.

As the free piston 3 is propelled upwardly through the tubing string 10 it passes through the valve 4 and is sensed by the sensor 13 and eventually movement thereof is arrested by the spring (not shown) in the lubricator sub 7 and the catching unit 5. When the free piston is detected by the sensor 13 a signal is transmitted to the controller 12 which initiates closure of the valve 10. The free piston 3 is then allowed to again fall or gravitate to the bottom of the well so that the cycle may be repeated.

Figure 8:
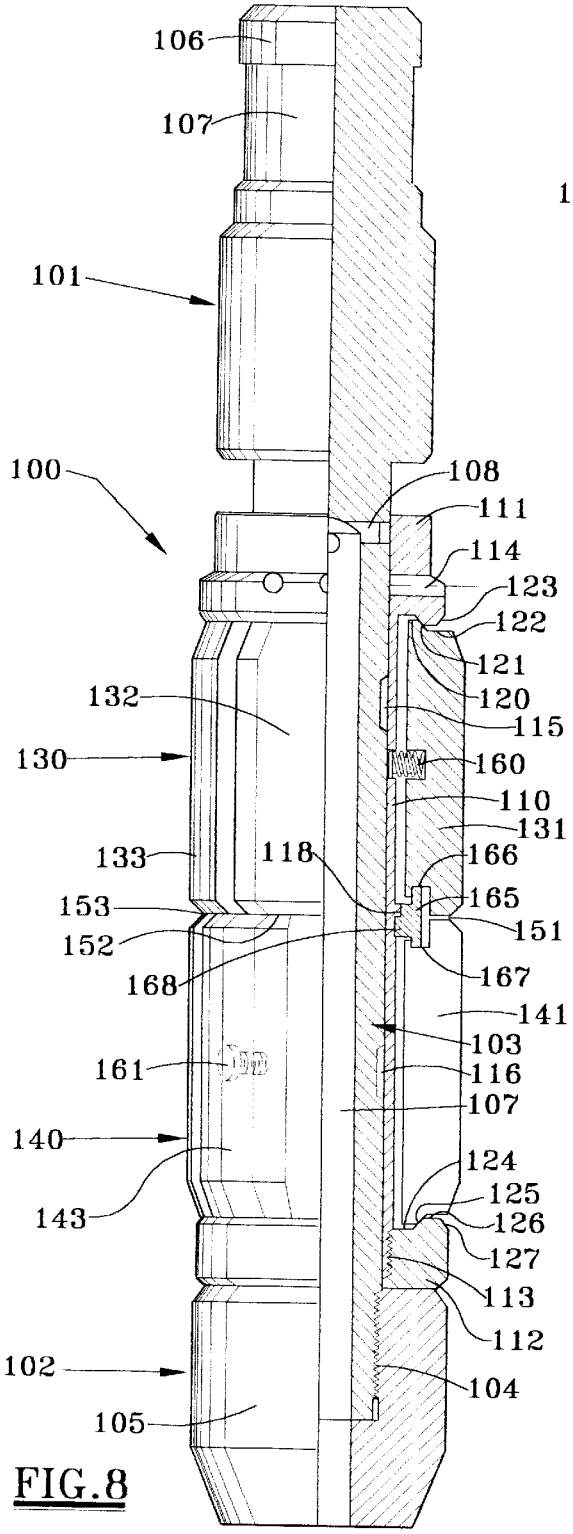
FIG. 8 is a longitudinal view, in quarter section, of a differential pressure operated piston according to another preferred embodiment of the invention, the piston being shown in its pumping or lifting position.
Figure 9:
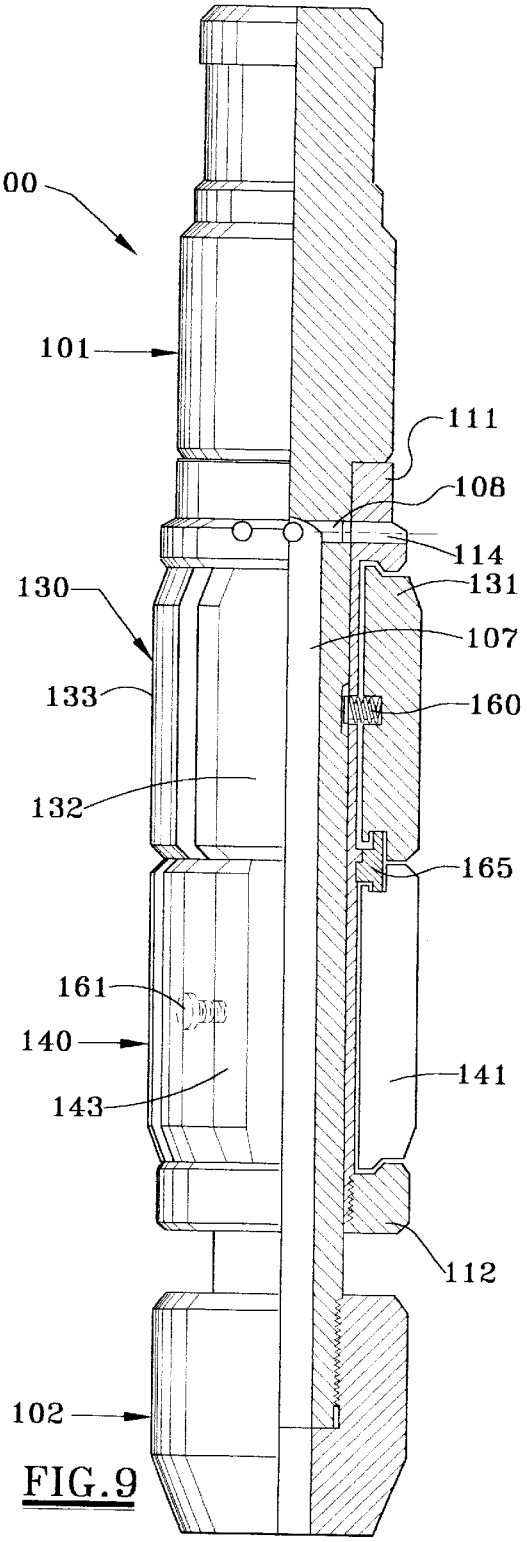
FIG. 9 is a longitudinal view, in quarter section, of the differential pressure operated piston of FIG. 8 shown in its falling or returning to the bottom of the well position.

Referring now to FIGS. 8 and 9, an alternate embodiment of the invention will be described which, unlike the embodiment of FIGS. 2–5, is provided with a central flow passage or bypass which is closed while pumping or lifting fluids through the well but which may be opened when the piston is falling or gravitating to the bottom of the well, allowing bypass of fluids therethrough and hastening the descent of the piston to the bottom of the well.

Like the previously described embodiment, the free piston 100 of FIGS. 8 and 9 has a piston body made up of an upper portion 101, a lower portion 102 and an intermediate cylindrical portion 103 of reduced diameter. Downwardly facing surfaces of the upper portion 101, upwardly facing surfaces of the lower portion 102 and the exterior of the intermediate portion 103 substantially define an elongated cylindrical space having a central axis which coincides with the axis of the piston body 101, 102, 103. In this embodiment, the lower portion 102 of the piston body may be bored and tapped to provide a threaded connection 104 with corresponding threads on the lower end of the intermediate body portion 103. Wrench flats 105 may be provided to aid in engagement or disengagement of the threaded connection 104. Removal of the lower portion 102 allows disassembly of the components of the free piston 100. The upper portion 101 of the free piston body may include a cylindrical head 106 and a reduced diameter neck 107 for engagement by fishing tools if it ever becomes necessary to mechanically retrieve the free piston 100 from the well.

A central flow passage 107 is provided in the lower portion 102 and the intermediate portion 103 of the piston body. The upper end of the passage 107 terminates near the upper portion of the intermediate body portion 103. However a number of radial ports 108 provide fluid communication between the central passage 107 and the exterior of the central piston body portion 103. The function of the central passage 107 and the radial ports 108 will be more fully understood hereafter.

Surrounding the intermediate portion 103 of the piston body is a sealing assembly which includes a sleeve member 110 which surrounds the intermediate piston body portion 103 and the length of which is less than the length of the elongated space partially defined thereby, allowing limited axial movement of the sleeve 110 and the entire sealing assembly within the cylindrical space between upper and lower terminal positions therein. The sleeve and sealing assembly are shown in the lower terminal position of FIG. 8 and the upper terminal position in FIG. 9. The sleeve member 110 has an upper enlarged portion 111 and a lower enlarged portion 112. The lower portion 112 is shown as a separate component threadedly connected at 113 to the lower end of the sleeve 110. Disengagement of the threaded connection 113 allows removal of the lower sleeve portion 112 and disassembly of other components of the sealing assembly. The upper enlarged portion 111 of the sleeve member 110 may be provided with radial ports 114. When the sealing assembly is in the lower terminal position of FIG. 8, these radial passages 114 are blocked by the intermediate portion 103 of the piston body and the radial passages 108 through the intermediate portion 103 of the piston body are likewise blocked by the upper enlarged portion 111 of the sleeve member 110. However, when the sealing assembly is in the upper terminal position of FIG. 9, the radial passages 108 and 114 are in registration with each other allowing flow through the central passage 107 and radial passages 108, 114, bypassing portions of the sealing assembly.

The lower end of the enlarged upper sleeve portion 111 is provided with downwardly facing surfaces 120 and 122 joined by frusto-conical surface 121. A frusto-conical surface 123 connects the surface 122 with the major outside diameter of the upper sleeve portion 111. The surface 121 and 122 are highly polished to help form a metal-to-metal seal as will be more fully understood hereafter. The surfaces 120 and 121, along with the external surface of the sleeve body 110 form a downwardly facing groove the purpose of which will be more clearly understood hereafter.

The lower sleeve component 112 is also provided with a pair of upwardly facing surfaces 124 and 126 joined by frusto-conical surface 125. A frusto-conical surface 127 connects the surface 126 with the major external diameter of the sleeve component 112. The surfaces 125 and 126, as with surfaces 121 and 122 of the upper enlarged sleeve portion 111, are also highly polished to help provide a metal-to-metal type seal. The surfaces 124 and 125, along with the exterior surfaces of the sleeve 110 form an upwardly facing groove.

The seal assembly includes, surrounding the sleeve 110, two sets of longitudinally separated cylindrical segments, an upper set 130 and a lower set 140. In the alternate embodiment of FIGS. 8 and 9, the upper set 130 is formed of four identical cylindrical segments 131, 132, 133, 134. The lower set also has four identical cylindrical segments 141, 142, 143 and 144. Each of the segments 131–134 and 141–144 provide relatively smooth cylindrical surfaces on the exterior thereof for sliding and sealing contact with the walls of conduits, such as a tubing T of FIG. 1. The lower ends of each segment of the upper set of segments 131–134 and upper ends of each segment of the lower set of segments 141 144 are provided with relatively smooth, mutually engaging surfaces for metal-to-metal sliding and sealing contact as at 151, 152, 153. The upper and lower set of segments 130, 140 are essentially identical to the upper and lower set of segments 40 and 60 of the embodiment of FIGS. 2–5.

Figure 7:
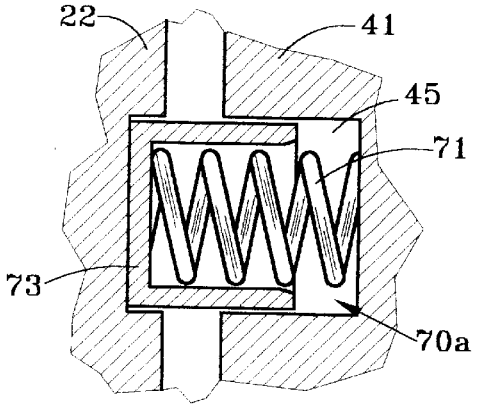
FIG. 7 is a detailed drawing, partially in section, of an alternate embodiment of a biasing element for use with the present invention.

Each of the cylindrical segments 131–134, 141–144 of the upper and lower sets of segments 130 and 140, respectively, are radially moveable between inner positions in which the exterior of the cylindrical surfaces thereof lie within a circle whose diameter is less than any anticipated restriction which may be encountered in the conduit or tubing T, and outer positions in which said exterior cylindrical surfaces slidingly and sealingly engage the inner walls of the conduit or tubing T. Biasing means, such as the spring assembly 160 in either the form of the spring assembly 70 of FIG. 6 or 70 of FIG. 7 are disposed between the cylindrical segments 131–134 and 141–144 and the intermediate piston body portion 103, through radial roles provided in the sleeve member 110. These biasing assemblies 160 bias the segments 131–134 and 141–144 toward their outer positions. It will be noted that recesses or grooves 115 and 116 are provided around the exterior of the intermediate body portion 103 of the piston body. When the sealing assembly is in the lower terminal position of FIG. 8, these recesses 115, 116 are covered or blocked by the sleeve member 110. However, when the sealing assembly is in the upper terminal position of FIG. 9, these recesses 115, 116 are in registration with the spring assemblies 160, 161. This allows the axial length of the spring assemblies 160, 161 to expand, decreasing the outwardly biasing forces on the sealing segments 131–134 and 141–144 so that they do not engage the inner walls of the conduit or tubing T through which the free piston is passing, when in the upper terminal position of FIG. 9, in complete sealing contact. In fact the spring assemblies can be designed so that there's actually a slight clearance between their exterior surfaces and the conduit or tubing through which the free piston passes.

The sealing assembly, like in the previously described embodiment, also includes a rigid ring member 165. However, in this embodiment it surrounds the sleeve 110 rather than the intermediate portion 103 of the piston body. The ring member 165 has upper and lower highly polished end surfaces 166, 167 which engage corresponding segmented annular recesses on the lower ends of the upper set of cylindrical segments 130 and the upper end of the lower set of cylindrical segments 140, as in the previously described embodiment, so that the outer radial movement of the cylindrical segments 131–134 and 141–144 are limited. The ring member 165 has an inner shoulder 168 which butts against a shoulder 118 of the sleeve 110 to hold the ring 165 in its proper longitudinal position when assembled. The end surfaces of the ring member 165 and the corresponding surfaces in the annular recesses of segments 131–134 and 141–144 are highly polished for mutually sliding and sealing engagement therebetween. Thus, metal-to-metal sliding seals are provided, as already stated, at mutual contacts 151–154 between the upper and lower set of segments 131–134 and 141–144, respectively, and contact of these segments with the upper and lower ends 166 and 167 of the ring 165.

Like in the previously described embodiment of FIGS. 1–5, the segments 131–134 of the upper set of segments 130 and the segments 141–144 of the lower set of segments 140 are radially oriented so that the longitudinal separations between the segments of the upper set 130 and between the segments of the lower set 140 are not aligned. In the described embodiment one set is rotated forty-five degrees relative to the other set. In this manner one end of the separations between segments of one set are blocked by mutually engaging surfaces on the opposing set of segments. The orientation of the upper and lower set of segments 130, 140 and the mutually engaging sealing surfaces on the ends of the segments 131–134, 141–144 with each other and with the corresponding surfaces of the ring 165 provide a seal which allows the free piston 100 to gravitate through a conduit such as tubing T and provides sufficient sealing, when pressure in the well conduit near the surface is subsequently reduced, to elevate the piston 100 and well fluids thereabove to the surface.

Like the free piston 3 of the embodiment of FIGS. 1–5, the free piston 100 may be placed in the production string T through a lubricator sub, such as the sub 7 shown in FIG. 1. This is done by removing the cap 8 while the valve 4 is closed. Then the cap 8 is replaced and the valve opened, allowing the free piston 100 to gravitate or fall to the bottom of the well through the tubing string T. As this occurs, the sleeve and the other components of the sealing assembly will shift to the upper terminal position shown in FIG. 9. With the sealing assembly in the upper terminal position of FIG. 9, the central flow passage 107 and the radial passages 108, 114 provide a bypass allowing fluids to flow from beneath the free piston 100 to above the sealing assembly. In addition, the upper and lower set of segments 130, 140 and the biasing assemblies 160, 161 thereof are in the positions in FIG. 9, where there is reduced outwardly biasing pressure on the sealing segments 131–134 and 141–144. Thus, the free piston 100 is allowed to fall under its own weight toward a stop, such as the stop 2 in FIG. 1 which will eventually arrest its downward movement. Because fluids are allowed to bypass, the free piston 100 of FIGS. 8 and 9 gravitates to the bottom of the well much more rapidly than the free piston of the embodiment of FIGS. 2–5 allowing more frequent cycles of pumping.

When the free piston 100 engages the stop 2 to arrest its movement, the sleeve 110 and the other components of the sealing assembly, due to inertia and gravity, fall to the terminal position of FIG. 8. In this position, the central passage 107 is blocked from flow and the biasing assemblies 160, 161 again bias the segments 131–134 and 141–144 of the upper and lower set of segments 130 and 140 outwardly with sufficient force to provide an efficient sealing and sliding contact of the segments with the surrounding well conduit or tubing, such as tubing T of FIG. 1.

At the surface the motor operated valve 10 is closed and a time sequence initiated by its controller 12. Fluids enter the production string and gas pressure begins to build. The controller is programmed to keep the valve 10 closed until substantial fluids have entered the production string and sufficient gas pressure has built up. After a pre-determined amount of time, the controller opens the valve 10, substantially reducing pressure above the free piston 100 so that the pressure differential between the accumulated gas pressure below the free piston 100 and the pressure in the fluids above the free piston forces the free piston 100 and the fluids trapped thereabove upwardly through the well conduit or production string for production of the well.

As the free piston 100 is propelled upwardly through the tubing string it passes through the master valve, such as the valve 4 in FIG. 1, and is sensed by a sensor and movement thereof is eventually arrested by a spring in the lubricator sub. When the free piston is detected by the sensor a signal is transmitted to the controller which initiates closure of the production valve. The free piston 100 is then allowed to again fall, this time with the sealing assembly in the upper terminal position of FIG. 9, gravitating to the bottom of the well so that the cycle may be repeated. As previously stated, the bypassing through central passage 107 and radial passages 108, 114 and the reduced biasing against the segments of the upper set and lower set of segments 130, 140 allows the free piston 100 to fall at a much more rapid rate allowing the pumping or lifting cycles to be repeated on a more frequent basis.

The free piston of the present invention has a number of unique elements. The sealing assembly thereof is provided with two sets, one above the other, of longitudinal separated segmented sealing elements providing relatively smooth cylindrical surfaces for sliding and sealing engagement with the inner walls of a well conduit in which the piston is used. The lower ends of the upper set of segments and the upper ends of the lower set of segments provide relatively smooth mutually engaging surfaces and are radially oriented so that the longitudinal separations between the upper segments and the lower segments do not communicate with each other, preventing flow of fluids therethrough. A unique rigid ring surrounding the body of the piston, provides smooth surfaces which are mutually and sealingly engageable with the upper and lower sets of segmented sealing elements to prevent flow of fluids between the sealing assembly and the piston body on which it is carried. One embodiment of the invention provides a central passageway to allow bypassing of the sealing assembly. The sealing assembly is carried on a sleeve which in one position allows flow through the passageway and in another position prevents flow therethrough.

None of the sealing elements of the present invention are made of rubber or other resilient materials which may deteriorate over a period of time. They are all of metal or other hard rigid materials providing metal-to-metal type sealing. While the term "metal-to-metal" is used to describe sealing surfaces herein, it is intended that this term apply to any material which is rigid or non-resilient and hard enough to provide a metal-to-metal type seal.

Two embodiments of the invention and variations thereof have been described herein. However, many variations of the invention can be made by those skilled in the art without departing from the spirit of the invention. Accordingly, it is intended that the scope of the invention be limited only by the claims which follow.

I claim:

1. A differential pressure operated free piston for lifting well fluids from a subterranean reservoir to the surface through a well conduit which extends upwardly from said reservoir to said surface and which is provided near the lower end thereof with stop means, said free piston comprising:

a piston body adapted for up and down sliding disposition within said conduit having an upper portion, a lower portion and an intermediate portion of reduced diameter, downwardly facing surfaces of said upper portion, upper facing surfaces of said lower portion and the exterior of said intermediate portion substantially defining an elongated cylindrical space having a central axis which coincides with the axis of said piston body; and sealing means carried in said cylindrical space comprising upper and lower juxtaposed sets of longitudinally separated cylindrical segments, each of said segments providing relatively smooth cylindrical surfaces on the exterior thereof for sliding and sealing contact with inner walls of said conduit, the lower ends of each segment of said upper set and the upper ends of each segment of said lower set providing relatively smooth mutually engaging surfaces for sliding and sealing contact therebetween, said upper and lower set of segments being radially oriented so that separations between the segments of said upper set and separations between the segments of said lower set are not aligned, said separations of each set of segments being blocked by mutually engaging surfaces on the opposing set of segments, said sealing means including a rigid ring member surrounding said intermediate portion of said piston body having upper and lower surfaces mutually and respectively, sealingly engageable by corresponding surfaces on said lower ends of said upper set of cylindrical segments and said upper ends of said lower set of cylindrical segments, said sealing means providing a seal which allows said free piston to gravitate through said conduit toward said stop means and providing sufficient sealing, when pressure in said well conduit near said surface is subsequently reduced, to elevate said piston and well fluids thereabove to said surface.

2. The differential pressure operated free piston of claim 1 in which each of said cylindrical segments of said upper and lower sets of segments is radially moveable between inner positions, in which said exterior cylindrical surfaces thereof lie within a circle the diameter of which is less than any anticipated restriction which may be encountered in said conduit, and outer positions in which said exterior cylindrical surfaces slidingly and sealingly engage said inner walls of said conduit.

3. The differential pressure operated free piston of claim 2 including biasing means disposed between said cylindrical segments and said intermediate piston body portion biasing said segments toward said outer positions.

4. The differential pressure operated free piston of claim 3 in which the upper and lower outer ends of said segments are tapered so that upon engagement of either end of said segments with a restriction in said well conduit, whether said piston is moving downwardly or upwardly within said well conduit, said segments will be forced inwardly toward said inner positions sufficiently to pass through said restriction.

5. The differential pressure operated free piston of claim 3 in which said biasing means comprises spring members disposed between said cylindrical segments and said intermediate piston body portion.

6. The differential pressure operated free piston of claim 1 in which said upper and lower surfaces of said ring member are correspondingly disposed in segmented annular recesses on the lower ends of said upper set of cylindrical segments and the upper ends of said lower set of cylindrical segments so that said ring member limits outer radial movement of said cylindrical segments.

7. The differential pressure operated free piston of claim 6 including a downwardly opening annular recess at the upper end of said cylindrical space in which are disposed upwardly extending ridges of said upper set of cylindrical segments, and an upwardly opening annular recess at the lower end of said cylindrical space, in which are disposed downwardly extending ridges of said lower set of cylindrical segments, said annular recesses and said ridges cooperating to assist in limiting outer radial movement of said cylindrical segments.

8. The differential pressure operated free piston of claim 1 in which at least one of said upper and lower body portions removably engages said intermediate body portion, removal of said one of said upper and lower body portions allowing removal and replacement of said sealing means.

9. A differential pressure operated free piston for lifting well fluids from a subterranean reservoir to the surface through a well conduit which extends upwardly from said reservoir to said surface and which is provided near the lower end thereof with stop means, said free piston comprising:

a piston body adapted for up and down sliding disposition within said conduit having an upper portion, a lower portion and an intermediate portion of reduced diameter, downwardly facing surfaces of said upper portion, upper facing surfaces of said lower portion and the exterior of said intermediate portion substantially defining an elongated cylindrical space having a central axis which coincides with the axis of said piston body; and sealing means carried in said cylindrical space, said sealing means comprising a sleeve member surrounding said intermediate piston body portion and the length of which is less than the length of said elongated cylindrical space, allowing limited axial movement of said sealing means within said cylindrical space between upper and lower terminal positions therein, said sealing means also comprising upper and lower juxtaposed sets of longitudinally separated cylindrical segments, each of said segments providing relatively smooth cylindrical surfaces on the exterior thereof for sliding and sealing contact with inner walls of said conduit, the lower ends of each segment of said upper set and the upper ends of each segment of said lower set providing relatively smooth mutually engaging surfaces for sliding and sealing contact therebetween, said upper and lower set of segments being radially oriented so that separations between the segments of said upper set and separations between the segments of said lower set are not aligned, said separations of each set of segments being blocked by mutually engaging surfaces on the opposing set of segments, said sealing means providing a seal which allows said free piston to gravitate through said conduit toward said stop means and providing sufficient sealing, when pressure in said well conduit near said surface is subsequently reduced, to elevate said piston and well fluids thereabove to said surface.

10. The differential pressure operated free piston of claim 9 in which said piston body is provided with a central flow passage the lower end of which may communicate with the portion of said well conduit below said sealing means and the upper end of which is connected to one or more radial passages in said intermediate piston body portion above said upper set of cylindrical segments, said one or more radial passages being blocked by said sleeve member when in its lower terminal position blocking fluid flow through said central flow passage, said sleeve member being provided with one or more radial passages which, when said sleeve member is in its upper terminal position, are in corresponding registration with said one or more radial passages in said intermediate piston body portion to allow fluid flow through said central flow passage.

11. The differential pressure operated free piston of claim 10 in which each of said cylindrical segments of said upper and lower sets of segments is radially moveable between inner positions, in which said exterior cylindrical surface thereof lie within a circle the diameter of which is less than any anticipated restriction which may be encountered in said conduit and outer positions in which said exterior cylindrical surfaces slidingly and sealingly engage said inner walls of said conduit.

12. The differential pressure operated free piston of claim 11 including biasing means disposed between said cylindrical segments and said intermediate body portion biasing said segments toward said outer positions.

13. The differential pressure operated free piston of claim 12 in which said biasing means comprises at least one axially compressed spring for each of said segments one end of each spring engaging the interior surface of a respective segment and the opposite end of said spring engaging said intermediate body portion through a corresponding aperture in said sleeve.

14. The differential pressure operated free piston of claim 13 in which the exterior of said intermediate body portion is provided with recessed areas which, when said sleeve member is in said upper terminal position, are in registration with said springs allowing ends of said springs to move radially into said recessed areas and preventing complete sealing engagement of said exterior cylindrical surfaces of said segments with said inner walls of said conduit and allowing at least some fluid flow around said sealing means.

15. The differential pressure operated free piston of claim 9 in which said sealing means includes a rigid ring member having upper and lower surfaces mutually, slidingly and sealingly engaging respectively corresponding surfaces on said lower ends of said upper set of cylindrical segments and said upper ends of said lower set of cylindrical segments.

16. The differential pressure operated free piston of claim 15 in which said upper and lower surfaces of said ring member are correspondingly disposed in segmented annular recesses on the lower ends of said upper set of cylindrical segments and the upper ends of said lower set of cylindrical segments limiting outer radial movement of said cylindrical segments.

17. The differential pressure operated free piston of claim 16 in which the upper and lower ends of said sleeve member are provided with downwardly and upwardly opening annular recesses respectively, in the downwardly opening recess of which are disposed upwardly extending ridges of said upper set of segments and in the upwardly opening recess of which are disposed downwardly extending ridges of said lower set of segments, said recesses and said ridges cooperating in limiting outer radial movement of said cylindrical segments.

18. The differential pressure operated free piston of claim 9 in which at least one of said upper and lower body portions is removably connected to said intermediate body, allowing removal of said sealing means therefrom.

* * * * *